US006244525B1

(12) United States Patent
Gallup et al.

(10) Patent No.: US 6,244,525 B1
(45) Date of Patent: Jun. 12, 2001

(54) FUEL INJECTOR FOR AN INTERNAL COMBUSTION ENGINE

(75) Inventors: David Gallup; Christine Estevenon, both of Osny (FR)

(73) Assignee: Sagem S.A., Paris (FR)

( * ) Notice: Subject to any disclaimer, the term of this patent is extended or adjusted under 35 U.S.C. 154(b) by 0 days.

(21) Appl. No.: 09/600,555

(22) PCT Filed: Jan. 18, 1999

(86) PCT No.: PCT/FR99/00084

§ 371 Date: Jul. 19, 2000

§ 102(e) Date: Jul. 19, 2000

(87) PCT Pub. No.: WO99/36692

PCT Pub. Date: Jul. 22, 1999

(30) Foreign Application Priority Data

Jan. 20, 1998 (FR) ..... 98 00554

(51) Int. Cl.[7] ..... F02M 61/00
(52) U.S. Cl. ..... 239/533.12; 239/585.1
(58) Field of Search ..... 239/533.2, 533.12, 239/463, 494, 585.1

(56) References Cited

U.S. PATENT DOCUMENTS 4,971,254 * 11/1990 Daly et al. ..... 239/585.1
5,570,841 * 11/1996 Pace et al. ..... 239/585.1
5,871,157 * 2/1999 Fukutomi et al. ..... 239/463
5,875,972 * 3/1999 Ren et al. ..... 239/463
5,931,386 * 8/1999 Jouillat ..... 239/463
5,979,801 * 11/1999 Munezane et al. ..... 239/533.12
6,024,301 * 2/2000 Hurley et al. ..... 239/492
6,065,692 * 5/2000 Brinn, Jr. ..... 239/533.12

* cited by examiner

*Primary Examiner*—Thomas N. Moulis
(74) *Attorney, Agent, or Firm*—Larson & Taylor PLC

(57) ABSTRACT

The fuel injector comprises an injector body (10) containing a needle (12) terminated by a shutter element co-operating with a fuel-passing seat (28) that is extended by a diffusion hole, the needle also being displaceable between a first axial position in which the shutter element bears against the seat and a second position in which the shutter element is spaced apart from the seat, the injector also comprising a swirling chamber for putting the fuel into rotation about the axis of the shutter element and situated upstream from the seat. The chamber is defined by the upstream face of the seat (28), by a disk (42) pressed against the seat and having slots (48) opening out tangentially into a central opening (46) surrounding the shutter element, and by a needle guide (40) constituted in such a manner as to feed the outer ends of the slots.

8 Claims, 2 Drawing Sheets

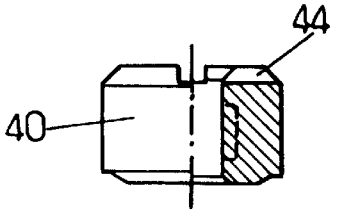
FIG. 3.
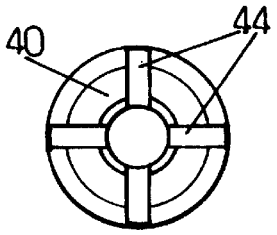
FIG. 4.
FIG. 5.
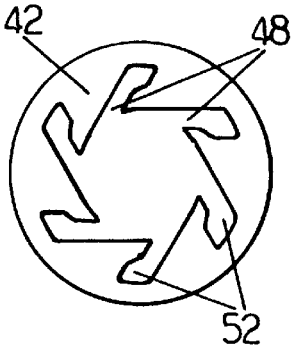
FIG. 6.
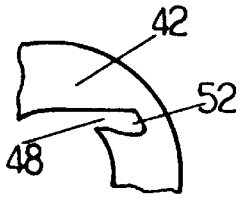
FIG. 7.
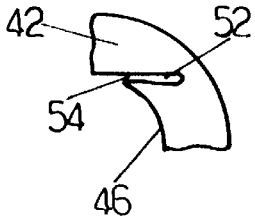

FUEL INJECTOR FOR AN INTERNAL COMBUSTION ENGINE

BACKGROUND OF THE INVENTION

The present invention relates to injectors for injecting fuel in the fluid state, in particular the liquid state, for the purpose injecting the fuel directly into a combustion chamber of a controlled ignition engine. It is particularly applicable to injecting gasoline, but it can also be adapted to other liquid fuels, such as alcohol-based fuels and liquefied petroleum gas.

Direct injection injectors are already known comprising an injector body containing a needle that is axially displaceable by electrical control means (often constituted by a coil) and terminated by a shutter member, often of hemispherical shape, that co-operates with a fuel flow seat. The needle is displaceable between a first axial position in which the shutter element bears against the seat and a position in which it is spaced apart therefrom.

The stresses imposed on the injector for direct injection are much higher than those for indirect injection into a manifold. It is necessary both to limit the penetration depth of the fuel jet, e.g. to avoid wetting the walls of the chamber, and to ensure mixing that is as intimate as possible between the air and the fuel for better combustion, and to do this even though the time available for fuel injection is very short.

To achieve this result, attempts have already been made to impart turbulent motion to the fuel. Document WO-A-96/36808 describes an injector performing that function. It has a swirling chamber for putting the fuel into rotation about the axis of the shutter element, which chamber is situated upstream from the seat so as to avoid the presence of a dead volume between the seat and the spray hole.

SUMMARY OF THE INVENTION

The present invention seeks in particular to provide a fuel injector that satisfies practical requirements better than previously known injectors, in particular in that it causes the fuel to be set into rotation by using means that are simple to implement while nevertheless being very effective.

To this end, the invention provides a fuel injector having a swirling chamber is defined by the upstream face of the seat, by a disk pressed against the seat and having slots opening out tangentially into a central opening surrounding the shutter element, and by a needle guide constituted in such a manner as to feed the outer ends of the slots.

The vortex effect achieved in this way has various consequences. The swirling of the vaporized fuel that passes through the diffusion hole that can be shut by the shutter element improves air-gasoline mixing and lengthens the path required before particles can reach the walls.

The disk is advantageously clamped between the guide, bearing against an inside shoulder of the body, and the seat which is fixed to the body in permanent manner, e.g. by welding. The path of the fuel towards the slots can be constituted by a radial jet provided between the guide and a bore of the body in which it is mounted. The needle which is then mounted as a sliding fit inside the guide enables the guide to be centered. The radial clearance required for a sliding fit is very small. It limits the passage for fluid, thereby improving the quality of the jet. The radial feed clearance can receive fuel via grooves formed in the upstream face of the guide, bearing against the internal shoulder.

In practice, the disk will have two to eight slots that can be rectilinear or angled in such a direction as to reinforce the rotation imparted by the slots opening out into the central opening.

The above characteristics and others will appear better on reading the following description of particular embodiments, given as non-limiting examples. The description refers to the accompanying drawings, in

BRIEF DESCRIPTION OF THE DRAWINGS

FIG. 3 is an elevation view in half-section of the guide of the injector shown in FIGS. 1 and 2;

FIG. 4 is a plan view of the guide of FIG. 3;

FIG. 5 is a plan view of a disk constituting a variant embodiment over that shown in FIG. 2; and FIGS. 6 and 7 are detailed views showing fragments of disks constituting variants of the disk shown in FIG. 2.

DETAILED DESCRIPTION

Figure 1:
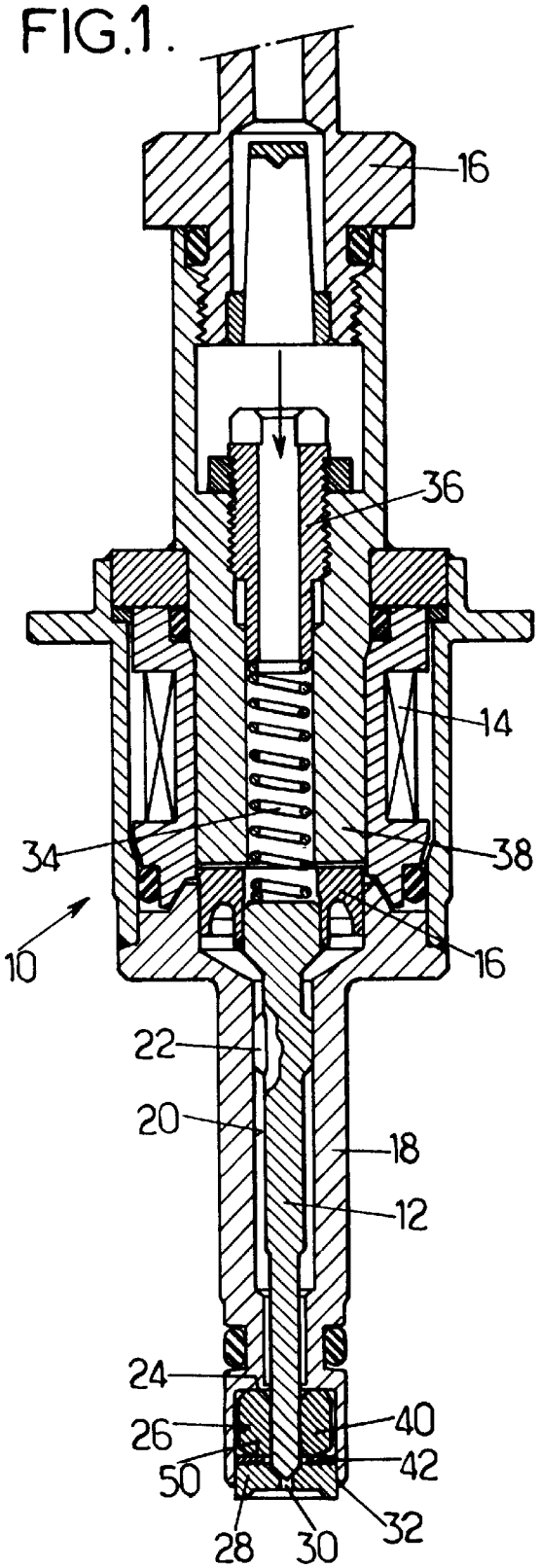
FIG. 1 is an overall view of an injector to which the invention is applied.

The injector whose general structure is shown in FIG. 1 comprises a body 10 built up of a plurality of assembled-together parts within which there is a needle 12 that is axially displaceable by a coil 14. For this purpose, the needle is fixed to a ring 16 of ferromagnetic material. The ring could equally well be controlled electrically by other means, e.g. by a stack of piezoelectric pellets, or could even be controlled by fluid pressure.

In the end portion 18 of the body 10 there is provided a bore 20 for guiding swellings 22 on the needle 12. The bore 20 is connected via a shoulder 24 to a countersink 26 having a seat 28 fixed thereto, generally by welding. A diffusion hole 30 is pierced through the seat and a bearing zone of a shutter element engages therein. In the example shown in FIG. 1, the seat 28 is held by a circular weld 32 made by means of a laser beam or an electron beam.

In the example shown, the shutter element of the injector is constituted by the end of the needle 12. By way of example, the bearing surface against which the needle bears is conical in shape whereas the end of the needle, in its bearing zones, is in the form of a spherical segment. The tip of the terminal portion of the needle can be conical in order to reduce the risk of cavitation.

A spring 34 compressed between the rear face of the needle 12 and an endpiece 36 whose position is adjustable for adjustment purposes, urges the needle 12 against the seat 28. The coil 14 enables the needle to be moved against the action of the spring 34 within limits set by the ring 16 coming into abutment against a fixed sleeve 38 which can be made of ferromagnetic material so as to close the magnetic control circuit.

In accordance with the invention, the injector is provided with swirling means for putting the fuel into rotation, which means are situated upstream from the seat. They comprise a guide 40 and a vortex generator disk 42 that are stacked in the countersink 26 between the seat 28 and the shoulder 24.

The guide 40 (FIGS. 1 to 4) has a cylindrical side wall of diameter that is slightly smaller than the diameter of the countersink 26. It is pierced by a hole of diameter such that the needle 12 is a sliding fit in the guide. The guide thus has another function. It defines an annular passage for feeding fuel to the seat. In order to reduce friction, it can have a recess of the kind shown in dashed lines in FIG. 3. It is centered in the countersink 26 by the needle which is guided at its top end by thrust against its swellings 22, and at its bottom end by bearing against the seat 28.

Figure 2:
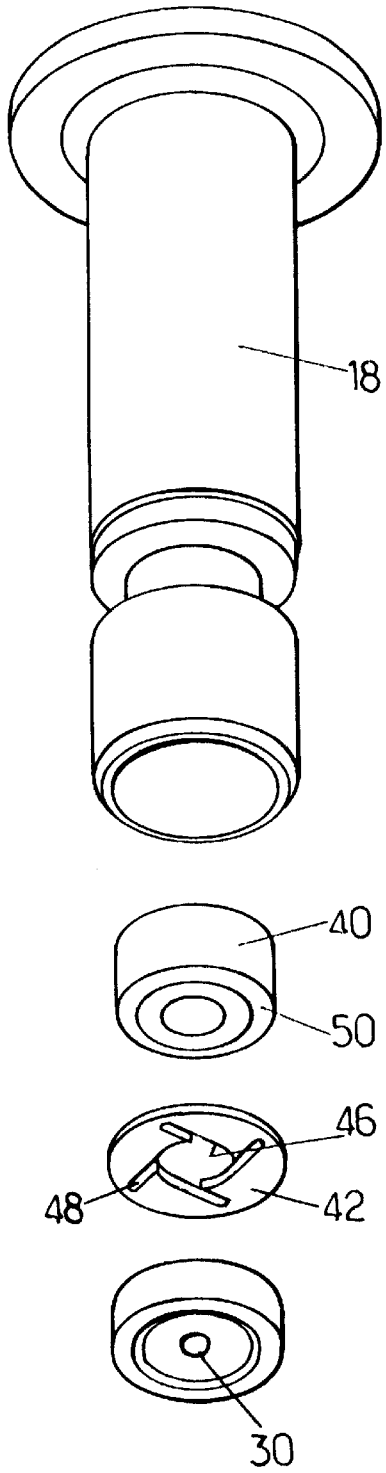
FIG. 2 is an exploded view in perspective of the bottom portion of the FIG. 1 injector.

The fuel reaches the annular passage 24 by passing successively through clearance left between the needle and the inside wall of the terminal portion 18 and along feed grooves 44, of which there are four in the example shown in FIGS. 2 to 4. To facilitate the passage of the fuel from the grooves towards the annular clearance, the upstream face of the guide is preferably chamfered.

The disk 42 is constituted by a thin flat part which is recessed so as to define a central cavity 46 that is generally circular in shape and into which slots 48 open out tangentially, the number of slots being four in the example shown in FIG. 2. The outer end of each slot is placed in such a manner that the fuel which has passed along the annular clearance can penetrate into the slots. A chamfer 50 can be provided on the downstream face of the guide 40 to make this improvement possible. The outside diameter of the disk 42 is such that it is received as a sliding fit in the countersink 26.

The disposition described above presents numerous advantages. All of the parts are simple in structure. Fuel feed takes place in perfectly symmetrical manner because the guide 40 is centered in the countersink 26. The flow rate characteristics of the injector can be modified very simply, merely by providing a range of different clearances for the disks 42 and/or the seats 28. The annular clearance has no appreciable effect on the flow rate that the injector can deliver.

The cutouts in the disk 42 can be of a wide variety of shapes. In the example shown in FIG. 5 (where elements corresponding to those of FIGS. 1 and 2 are given the same reference numerals), there are six slots 48. They have enlarged ends 52 oriented so as to perform a plurality of functions. They facilitate ingress of fuel into the slots 48. They start applying rotary motion to the fuel in the direction of arrow f because of the angles that they represent.

In FIG. 6, the slots 48 have end swellings 52 only.

In FIG. 7, each slot converges on a throttle 54 where it opens out into the central cavity 46.

The invention is also applicable to injectors in which the shutter means and/or the control means are different from those described above. In particular, it can be used when the shutter element is constituted by a ball fitted to the needle.

What is claimed is:

1. A fuel injector for injection of fuel into a combustion chamber of a controlled ignition engine, comprising:

an injector body;

a seat secured to said body and formed with an axial fuel spraying passage;

a needle having a shutter element at an end thereof, axially displaceable in said body between a first axial position in which the shutter element bears against the seat and closes said passage and a second position in which the shutter element is spaced apart from the seat; and a swirling chamber for causing rotation of the fuel about the axial direction and situated upstream from the seat, defined by:

an upstream surface of the seat, a disk in abutting contact with the seat, said disk having slots opening out tangentially into a central opening of said disk surrounding the shutter element, and a needle guide slidably receiving said needle, axially retained in said body and defining fuel passage means opening into radially outer ends of the slots, wherein said needle guide has a diameter smaller than a diameter of a counterbore of the body and is received in said counterbore with an annular clearance defining said passage means for feeding the slots.

2. An injector according to claim 1, wherein the upstream surface of the needle guide bearing against the internal shoulder is flat and formed with grooves for fuel delivery to the annular clearance.

3. An injector according to claim 1, wherein said needle guide has a downstream face formed with a chamfer for feeding fuel from said clearance to the outer ends of the slots.

4. An injector according to claim 1, wherein the disk has from two to eight said slots.

5. An injector according to claim 1, wherein said slots are rectilinear.

6. An injector according to claim 1, wherein said slots are angled so as to reinforce the rotation imparted by the slots opening out into the central opening.

7. A fuel injector comprising:

an injector body having an axis, formed with an axial bore and with a terminal counterbore of larger diameter than said bore;

a seat secured to said body in said counterbore and formed with an axial fuel delivery and spraying passage;

a needle having a terminal shutter element, axially displaceable between a first axial position in which the shutter element bears against the seat and closes said passage and a second position in which the shutter element is spaced apart from the seat;

a needle guide slidably receiving said needle and located in said counterbore in axial abutment against a shoulder limiting said counterbore; and a disk axially clamped between said needle guide and an upstream surface of said seat, wherein said upstream face of the seat, said disk which has a central opening communicating with said passage when said needle is in said second position and has slots opening out tangentially into said central opening surrounding the shutter element, and said needle guide define a swirling chamber opening into radially outer ends of the slots, said slots being fed with fuel by passage means formed along an inner wall of said counterbore.

8. A fuel injector for injection of fuel into a combustion chamber of a controlled ignition engine, comprising:

an injector body;

a seat welded to said body and formed with an axial fuel spraying passage;

a needle having a shutter element at an end thereof, axially displaceable in said body between a first axial position in which the shutter element bears against the seat and closes said passage and a second position in which the shutter element is spaced apart from the seat; and a stack axially clamped between a shoulder of the body and an upstream surface of the seat, including:

a cylindrical needle guide formed with an axial cylindrical bore extending over the whole length of the axial guide, in which said needle has a sliding fit, said guide being in abutting contact with said shoulder, and a flat disk in abutting contact with the seat and with the needle guide, wherein said slots open out tangentially into a central opening of said disk surrounding the shutter element, and wherein said needle guide defines fuel passage means opening into radially outer ends of the slots.

* * * * *